US009937378B2

(12) United States Patent
Dalebout et al.

(10) Patent No.: US 9,937,378 B2
(45) **Date of Patent: *Apr. 10, 2018**

(54) LATERAL ROLLER SUPPORT IN AN ELLIPTICAL

(71) Applicant: ICON Health & Fitness, Inc., Logan, UT (US)

(72) Inventors: William T. Dalebout, North Logan, UT (US); Gaylen Ercanbrack, Logan, UT (US)

(73) Assignee: ICON Health & Fitness, Inc., Logan, UT (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/046,717

(22) Filed: Feb. 18, 2016

(65) Prior Publication Data

US 2016/0243400 A1 Aug. 25, 2016

Related U.S. Application Data

(60) Provisional application No. 62/120,254, filed on Feb. 24, 2015.

(51) Int. Cl.
*A63B 22/00* (2006.01)
*A63B 71/00* (2006.01)
(Continued)

(52) U.S. Cl.
CPC ..... *A63B 22/0664* (2013.01); *A63B 22/001* (2013.01); *A63B 22/0017* (2015.10);
(Continued)

(58) Field of Classification Search
CPC ..... A63B 22/0664; A63B 2022/067; A63B 2022/0676; A63B 2022/0682; A63B 2022/0688; A63B 2022/0028; A63B 2022/003; A63B 2022/0033; A63B 2022/0035; A63B 2022/0038; A63B 2022/0041; A63B 2022/0043; A63B 2022/0611; A63B 2022/0629;
(Continued)

(56) References Cited

U.S. PATENT DOCUMENTS 5,993,359 A 11/1999 Eschenbach et al.
6,340,340 B1 * 1/2002 Stearns ..... A63B 21/15 482/52

(Continued)

FOREIGN PATENT DOCUMENTS

EP 0914842 B1 2/2003

*Primary Examiner* — Nyca T Nguyen
(74) *Attorney, Agent, or Firm* — Holland & Hart LLP

(57) ABSTRACT

An exercise machine includes a frame and a resistance mechanism attached to the frame. A crank assembly is in mechanical communication with the resistance mechanism, and the crank assembly includes a crank arm, a roller connected to the crank arm, and at least one internal load bearing surface integrated into the roller. A pedal assembly is movably attached to the crank assembly and movable in a performance of an exercise. The pedal assembly includes a pedal beam and a tensioned element that spans a first portion of an underside of the pedal beam. The tensioned element guides the roller with at least one internal load bearing surface during the performance of the exercise.

17 Claims, 10 Drawing Sheets

(51) Int. Cl.

| | |
|---|---|
| ***A63B 22/04*** | (2006.01) |
| ***A63B 3/00*** | (2006.01) |
| ***A63B 69/18*** | (2006.01) |
| ***A63B 22/06*** | (2006.01) |
| *A63B 21/22* | (2006.01) |
| *A63B 71/06* | (2006.01) |
| *A63B 21/005* | (2006.01) |
| *A63B 21/055* | (2006.01) |
| *A63B 21/00* | (2006.01) |

(52) U.S. Cl.
CPC ..... *A63B 22/0023* (2013.01); *A63B 71/0622* (2013.01); *A63B 21/0051* (2013.01); *A63B 21/0552* (2013.01); *A63B 21/151* (2013.01); *A63B 21/225* (2013.01); *A63B 22/0056* (2013.01); *A63B 2022/0688* (2013.01); *A63B 2071/065* (2013.01); *A63B 2071/0625* (2013.01); *A63B 2071/0647* (2013.01)

(58) Field of Classification Search
CPC . A63B 22/06; A63B 22/0605; A63B 22/0015; A63B 22/0017; A63B 22/0023; A63B 21/0552; A63B 21/151; A63B 21/152; A63B 21/154
See application file for complete search history.

(56) References Cited

U.S. PATENT DOCUMENTS

| | | | | |
|---|---|---|---|---|
| 6,422,977 | B1 | 7/2002 | Eschenbach et al. | |
| 6,626,802 | B1 * | 9/2003 | Rodgers, Jr. ..... | A63B 21/00181 482/110 |
| 7,468,021 | B2 | 12/2008 | Moon | |
| 7,618,350 | B2 | 11/2009 | Dalebout et al. | |
| 8,147,385 | B2 | 4/2012 | Crawford et al. | |
| 9,278,250 | B2 | 3/2016 | Buchanan | |
| 9,375,606 | B1 * | 6/2016 | Maresh ..... | A63B 22/04 |
| 2004/0058784 | A1 * | 3/2004 | Roberts, Jr. ..... | A63B 21/00181 482/52 |
| 2004/0147375 | A1 * | 7/2004 | Stevens ..... | A63B 22/001 482/57 |
| 2004/0187628 | A1 * | 9/2004 | Stevens ..... | A63B 22/001 74/560 |
| 2005/0075217 | A1 * | 4/2005 | Stevens ..... | A63B 22/001 482/52 |
| 2007/0054779 | A1 | 3/2007 | Lee | |
| 2007/0219062 | A1 * | 9/2007 | Rodgers ..... | A63B 21/151 482/52 |
| 2008/0188357 | A1 * | 8/2008 | Kuivala ..... | A63B 22/001 482/52 |
| 2009/0203501 | A1 * | 8/2009 | Rodgers, Jr. ..... | A63B 22/001 482/52 |
| 2010/0041522 | A1 | 2/2010 | Dalebout | |
| 2010/0255958 | A1 | 10/2010 | Lull et al. | |

* cited by examiner

LATERAL ROLLER SUPPORT IN AN ELLIPTICAL

RELATED APPLICATIONS

This application claims priority to U.S. Patent Application Ser. No. 62/120,254 titled "Lateral Roller Support in an Elliptical" and filed on Feb. 24, 2015, which application is herein incorporated by reference for all that it discloses.

BACKGROUND

Aerobic exercise is a popular form of exercise that improves one's cardiovascular health by reducing blood pressure and providing other benefits to the human body. Aerobic exercise generally involves low intensity physical exertion over a long duration of time. Generally, the human body can adequately supply enough oxygen to meet the body's demands at the intensity levels involved with aerobic exercise. Popular forms of aerobic exercise include running, jogging, swimming, and cycling among others activities. In contrast, anaerobic exercise often involves high intensity exercises over a short duration of time. Popular forms of anaerobic exercise include strength training and short distance running.

Many choose to perform aerobic exercises indoors, such as in a gym or their home. Often, a user will use an aerobic exercise machine to have an aerobic workout indoors. One such type of aerobic exercise machine is an elliptical exercise machine, which often includes foot supports that move in fixed reciprocating directions when moved by the feet of a user. Often, the foot supports will be mechanically linked to arm levers that can be held by the user during the workout. The arm levers and foot supports move together and collectively provide selective resistance against the user's motion during the user's workout. Other popular exercise machines that allow a user to perform aerobic exercises indoors include treadmills, rowing machines, stepper machines, and stationary bikes, to name a few.

One type of exercise device is disclosed in U.S. Pat. No. 5,993,359 issued to Paul Eschenbach, et al. In this reference, a standup cross trainer exercise apparatus simulates walking and jogging, having separately supported pedals for the feet and arm exercise, coordinated with the motion of the feet. Foot pedals move with a back and forth movement following an elongate curve path that has adjustable curve length during operation. The stride length of the foot pedals is adjustable to accommodate both long and short leg users. Foot pedals move with smooth elliptical motion resulting from a linkage mechanism having smooth orbital motion without the characteristic turnaround jerk associated with reciprocating member elliptical drives. Arm exercise in the disclosed reference is coordinated with the motion of the feet and adjusts with longer or shorter pedal strides to accommodate taller or shorter users. Other types of exercise machines are disclosed in U.S. Pat. No. 6,422,977 issued to Paul Eschenbach, et al. and U.S. Pat. No. 7,468,021 issued to Daniel R. Moon; and in U.S. Patent Publication No. 2007/0054779 issued to Lung-huei Lee. All of these references are herein incorporated by reference for all that they contain.

SUMMARY

In the preferred embodiment of the present invention, an exercise machine includes a frame and a resistance mechanism attached to the frame. A crank assembly is in mechanical communication with the resistance mechanism, and the crank assembly includes a crank arm, a roller connected to the crank arm, and at least one internal load bearing surface integrated into the roller. A pedal assembly is movably attached to the crank assembly and movable in a performance of an exercise. The pedal assembly includes a pedal beam and a tensioned element that spans a first portion of an underside of the pedal beam. The tensioned element guides the roller with at least one internal load bearing surface during the performance of the exercise.

In one aspect of the invention, the tensioned element is a cable.

In one aspect of the invention, the cable is sized to fit within a groove formed in a surface of the roller, wherein the at least one internal load bearing surface is a side wall of the groove.

In one aspect of the invention, the groove is formed within a middle seventy five percent of a rolling surface of the roller.

In one aspect of the invention, the exercise machine further includes a second tensioned element that spans a second portion of the underside of the pedal beam.

In one aspect of the invention, the cable is sized to fit within a groove formed in a surface of the roller the roller is disposed between the first tensioned element and the second tensioned element.

In one aspect of the invention, the exercise machine further includes a third tensioned element that spans the first portion of the underside of the pedal beam.

In one aspect of the invention, the exercise machine further includes a fourth tensioned element that spans the second portion of the underside of the pedal beam.

In one aspect of the invention, the first tensioned element and the second tensioned element are positioned to contact a first internal load bearing surface formed in a first groove of a rolling surface of the roller, and the third tensioned element and the fourth tensioned element are positioned to contact a second internal load bearing surface formed in a second groove of the rolling surface of the roller.

In one aspect of the invention, the first tensioned element and the third tensioned element impose a first force on the roller in a first direction as the roller moves with the performance of the exercise.

In one aspect of the invention, the first tensioned element and the third tensioned element impose a second force on the roller in a second direction different than the first direction as the roller moves with the performance of the exercise.

In one aspect of the invention, the first tensioned element and the second tensioned element each impose an increasing amount of resistance to movement of the roller as the roller approaches an underside location of the underside in the performance of an exercise.

In one aspect of the invention, the first tensioned element and the second tensioned element collectively prevent the roller from reaching an underside location of the underside in the performance of an exercise.

In one aspect of the invention, the at least one internal load bearing surface is a side wall of a groove formed in a rolling surface of the roller.

In one aspect of the invention, an exercise machine includes a frame.

In one aspect of the invention, a resistance mechanism is attached to the frame.

In one aspect of the invention, a crank assembly is in mechanical communication with the resistance mechanism.

In one aspect of the invention, the crank assembly includes a crank arm.

In one aspect of the invention, the crank assembly includes a roller connected to the crank arm In one aspect of the invention, the crank assembly includes roller connected to the crank arm.

In one aspect of the invention, a first groove with at least one load bearing surface in a first side wall formed in a rolling surface of the roller.

In one aspect of the invention, the groove is formed within a middle seventy five percent of the rolling surface.

In one aspect of the invention, a pedal assembly movably attached to the crank assembly and movable in a performance of an exercise.

In one aspect of the invention, the pedal assembly includes a pedal beam.

In one aspect of the invention, the pedal assembly includes a cable that spans a first portion of an underside of the pedal beam.

In one aspect of the invention, the cable is sized to fit within the first groove of the roller.

In one aspect of the invention, the cable guides the roller with at least one internal load bearing surface during the performance of the exercise.

In one aspect of the invention, the exercise machine includes a second cable that spans a second portion of the underside of the pedal beam.

In one aspect of the invention, the roller is disposed between the first cable and the second cable.

In one aspect of the invention, the exercise machine includes a third cable that spans the first portion of the underside of the pedal beam.

In one aspect of the invention, the exercise machine includes a fourth cable that spans the second portion of the underside of the pedal beam.

In one aspect of the invention, the first cable and the second cable are positioned to contact the first side wall formed in a first groove, and the third cable and the fourth cable are positioned to contact a second side wall formed in a second groove of the rolling surface of the roller.

In one aspect of the invention, the first cable and the third cable impose a first force on the roller in a first direction as the roller moves with the performance of the exercise, and the first cable and the third cable impose a second force on the roller in a second direction different than the first direction as the roller moves with the performance of the exercise.

In one aspect of the invention, an exercise machine includes a frame.

In one aspect of the invention, a resistance mechanism is attached to the frame.

In one aspect of the invention, a crank assembly is in mechanical communication with the resistance mechanism.

In one aspect of the invention, the crank assembly includes a crank arm.

In one aspect of the invention, the crank assembly includes a roller connected to the crank arm.

In one aspect of the invention, the crank assembly includes a first groove with at least one load bearing surface in a first side wall formed in a rolling surface of the roller.

In one aspect of the invention, the crank assembly includes that the groove is formed within a middle seventy five percent of the rolling surface.

In one aspect of the invention, a pedal assembly is movably attached to the crank assembly and movable in a performance of an exercise.

In one aspect of the invention, the pedal assembly includes a pedal beam.

In one aspect of the invention, the pedal assembly includes a first cable that spans a first portion of an underside of the pedal beam.

In one aspect of the invention, the pedal assembly a second cable that spans a second portion of the underside of the pedal beam.

In one aspect of the invention, the pedal assembly includes a third cable that spans the first portion of the underside of the pedal beam.

In one aspect of the invention, the pedal assembly includes a fourth cable that spans the second portion of the underside of the pedal beam.

In one aspect of the invention, the roller is disposed between the first cable and the second cable.

In one aspect of the invention, the first cable and the second cable are positioned to contact the first side wall formed in a first groove, and the third cable and the fourth cable are positioned to contact a second side wall formed in a second groove of the rolling surface of the roller.

In one aspect of the invention, the first cable and the third cable impose a first force on the roller in a first direction as the roller moves with the performance of the exercise, and the first cable and the third cable impose a second force on the roller in a second direction different than the first direction as the roller moves with the performance of the exercise.

Any of the aspects of the invention detailed above may be combined with any other aspect of the invention detailed herein.

BRIEF DESCRIPTION OF THE DRAWINGS

The accompanying drawings illustrate various embodiments of the present apparatus and are a part of the specification. The illustrated embodiments are merely examples of the present apparatus and do not limit the scope thereof.

Throughout the drawings, identical reference numbers designate similar, but not necessarily identical, elements.

DETAILED DESCRIPTION

Figure 1:
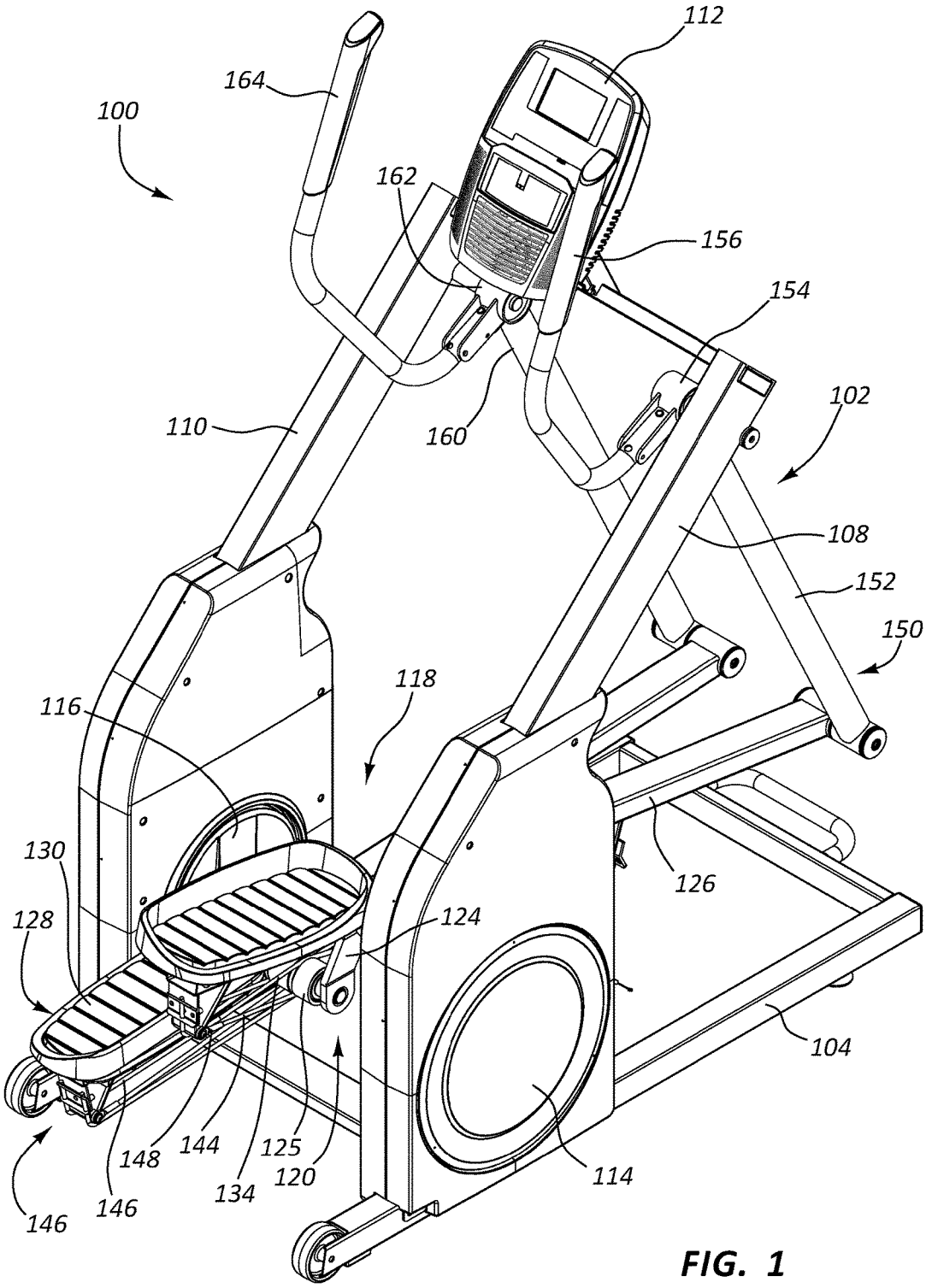
FIG. 1 illustrates a perspective view of an example of an exercise machine in accordance with the present disclosure.
Figure 2:
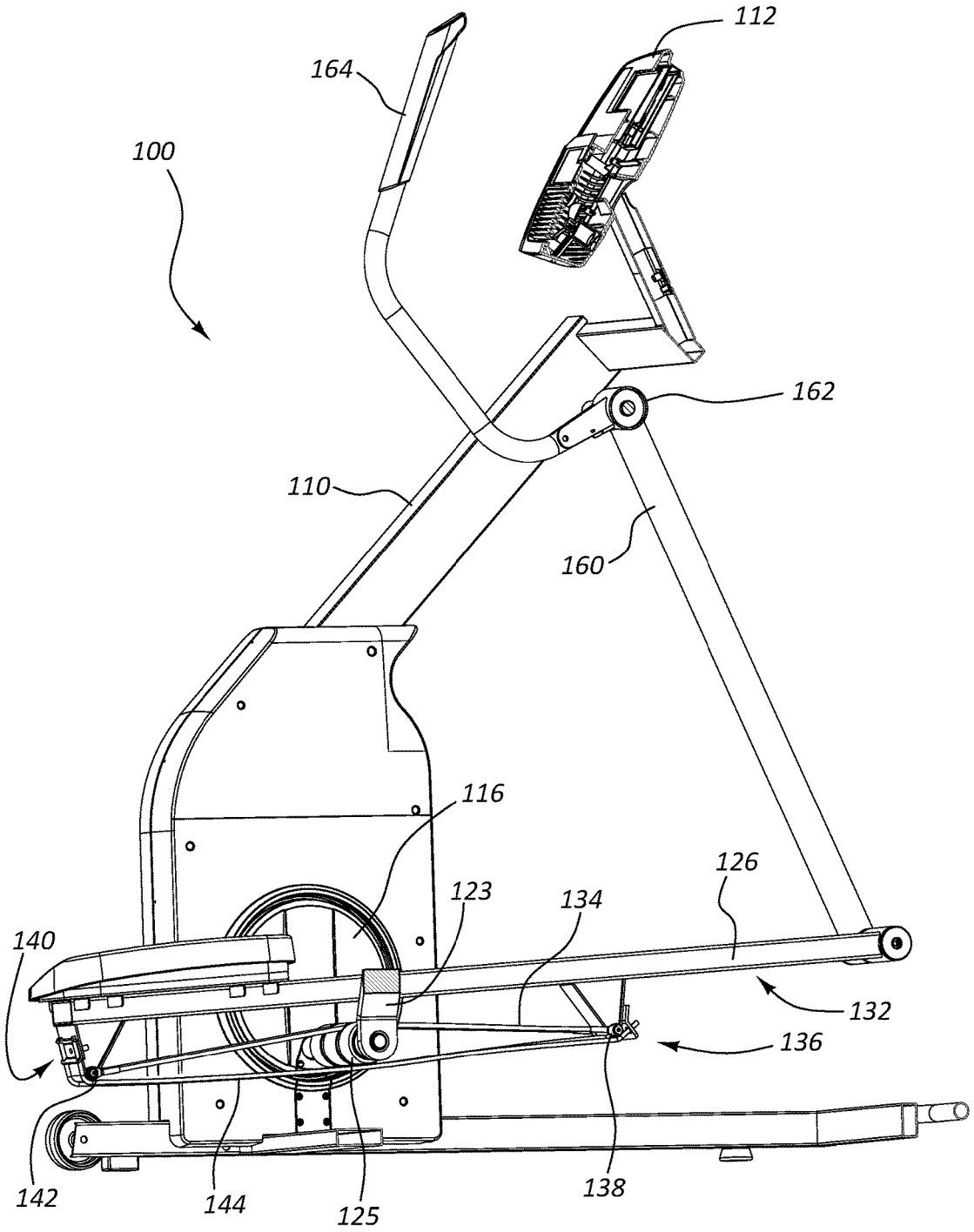
FIG. 2 illustrates a side cross sectional view of an example of an exercise machine in accordance with the present disclosure.

Particularly, with reference to the figures, FIGS. 1 and 2 depict an example of an exercise machine 100. The exercise machine 100 includes a frame 102 attached to a base 104. The frame 102 includes a first post 108 and a second post 110. A console 112 is connected to the first and second posts 108, 110. The first frame post 108 incorporates a first flywheel 114, and the second frame post 110 incorporates a second flywheel 116. The first flywheel 114 is connected to a first pedal assembly 118 through a crank assembly 120, and the second flywheel 116 is connected to a second pedal assembly 122 through the crank assembly 120.

The crank assembly 120 includes a first crank arm 124 connected to the first flywheel 114 and a second crank arm connected to the second flywheel 116. Each of the first crank arm 124 and the second crank arm 123 include a roller 125 that supports the weight of the pedal assemblies 118, 122 and a user standing thereon.

Each of the first pedal assembly 118 and the second pedal assembly 122 includes a pedal beam 126, and a pedal 128 is connected to the pedal beam 126. The pedal 128 may include a gripping surface 130 to grip a user's shoe as a user executes an exercise with the exercise machine 100. The pedal 128 may be bolted or otherwise fastened to the pedal beam 126.

A front end 150 of the pedal beam 126 of the first pedal assembly 118 is connected to a first arm lever 152 that connects to the frame 102 at a first pivot connection 154. The first pivot connection 154 is also attached to a first handle section 156 which is accessible to the user as the user is performing an exercise with the exercise machine 100. The pedal beam 126 of the second pedal assembly 122 is connected to a second arm lever 160 that connects to the frame 102 at a second pivot connection 162. The second pivot connection 162 is also attached to a second handle section 164 which is also accessible to the user as the user is performing an exercise with the exercise machine 100. As the pedal beams 126 move, the first and second handle sections 156, 164 move accordingly.

The console 112 may contain a display and controls. The controls may allow the user to specify a resistance level to be applied by the resistance mechanism, such as the first and second flywheels 114, 116. In some examples, the controls may also be used to control other operating parameters of the exercise machine, such as incline, side to side tilt, resistance, speaker volume, programmed exercise routines, other parameters, or combinations thereof. The display may show selected parameters to the user. Additionally, the display may be capable of presenting the user's physiological parameters, timers, clocks, scenery, routes, other types of information, or combinations thereof.

The pedal beam 126 includes an underside 132 with a first tensioned element 134 that spans at least a portion of the length of the underside 132. The tensioned element may be attached to a first underside location 136 at a first tensioned element end 138, and attached to a second underside location 140 at a second tensioned element end 142. In some examples, the tensioned element spans the entire length of the underside 132. Further, a second tensioned element 144 may also span at least a portion of the underside 132. In the illustrated example, the second tensioned element spans the entire length of the underside 132. In some examples, the first tensioned element 134 may span a different portion of the underside 132 than the second tensioned element 144, but such portions include an overlapping section in which the roller can travel. Further, in other examples, the first tensioned element 134 and the second tensioned element 144 span the same portion of the underside 132. In some examples, the first and second tensioned elements 134, 144 may have different tensions.

The roller 125 of the first and second crank arms 124, 123 may engage the first tensioned element 134. In some examples, the roller 125 is continuously engaged with the first tensioned element 134 during the performance of an exercise. Further, the first tensioned element 134 may be engaged with the roller 125 when the exercise machine 100 is not being used in the performance of an exercise. Further, the second tensioned element 144 may be continuously engaged with the roller 125 during the performance of an exercise. However, in some examples, the second tensioned element 144 is intermittently engaged with the roller 125 during a performance of an exercise. In such examples, the second tensioned element 144 may or may not be engaged with the roller 125 when the exercise machine is not being used during the performance of an exercise.

In the illustrated example, the first tensioned element 134 and the second tensioned element 144 are cables. However, any appropriate type of tensioned element may be used in accordance with the principles described in the present disclosure. For example, the tensioned elements may be straps, bands, belts, members made of an elastic material, other types of tensioned elements, or combinations thereof.

Further, a third tensioned element 146 and a fourth tensioned element 148 may also be attached to the underside 132 of the pedal beam 126. The third tensioned element 146 may apply a force in the same, or at least a similar direction, as the first tensioned element 134. The fourth tensioned element 148 may apply a force in the same, or at least a similar direction, as the second tensioned element 144. For example, the first and third tensioned elements 134, 146 may contact a top portion of the roller 125, and the second and fourth tensioned elements 144, 148 may contact a bottom portion of the roller.

In some cases, the pedal beams 126 can move some distance laterally even though the roller 125 is constructed to limit the lateral movement of the tensioned element. The tensioned element may include an elastic type material the stretches while under tension. Thus, as a lateral load moves the pedal beam 126 laterally, the tensioned element may stretch in a lateral direction. However, the tensioned element may reduce or otherwise restrict the amount of lateral movement that the pedal beams 126 can move. In some examples, the tensioned element can eliminate the lateral movement of the pedal beam 126 with respect to the roller 125.

Figure 3A:
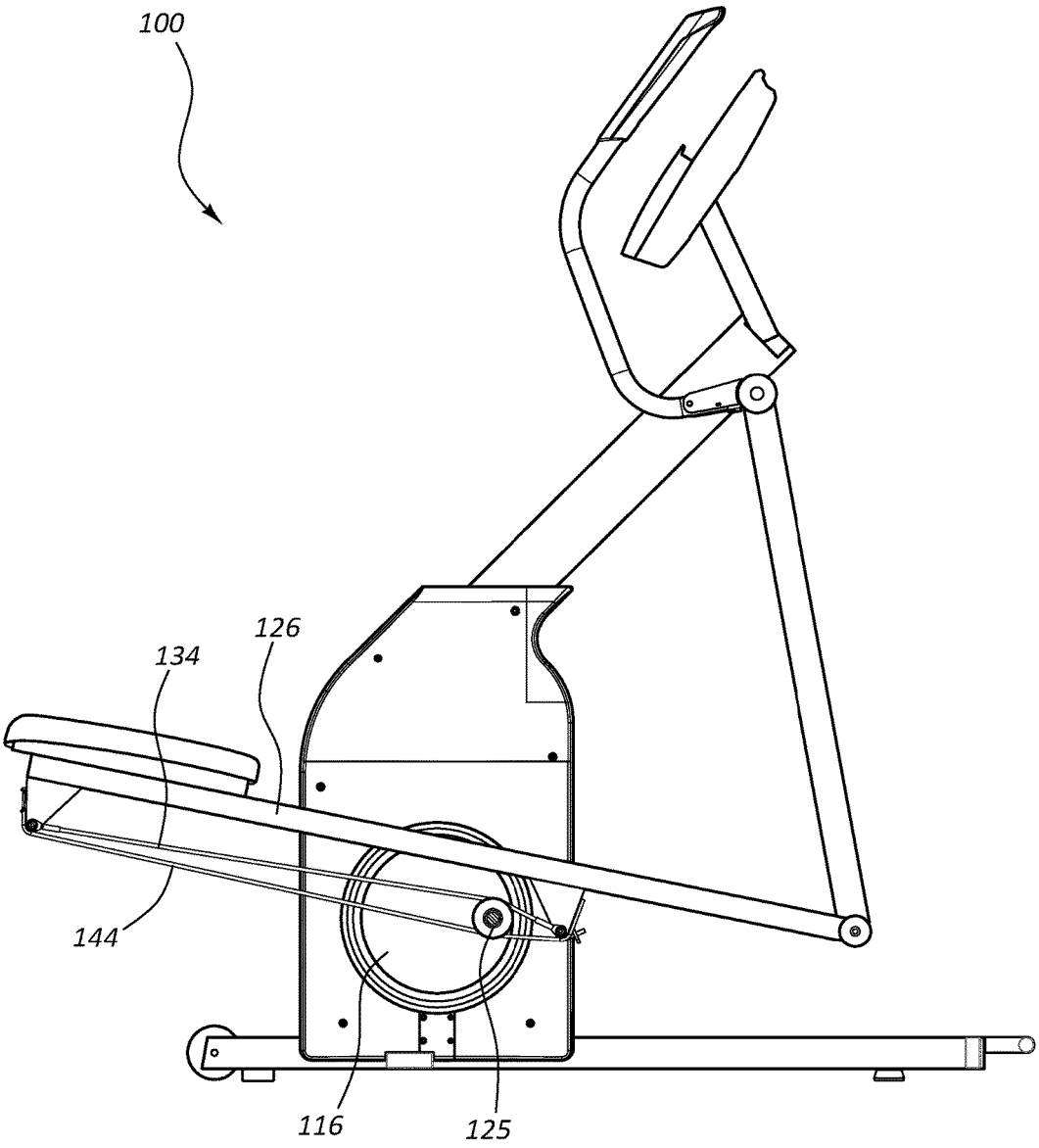
FIG. 3A illustrates a side view of an example of a pedal beam in accordance with the present disclosure.
Figure 3B:
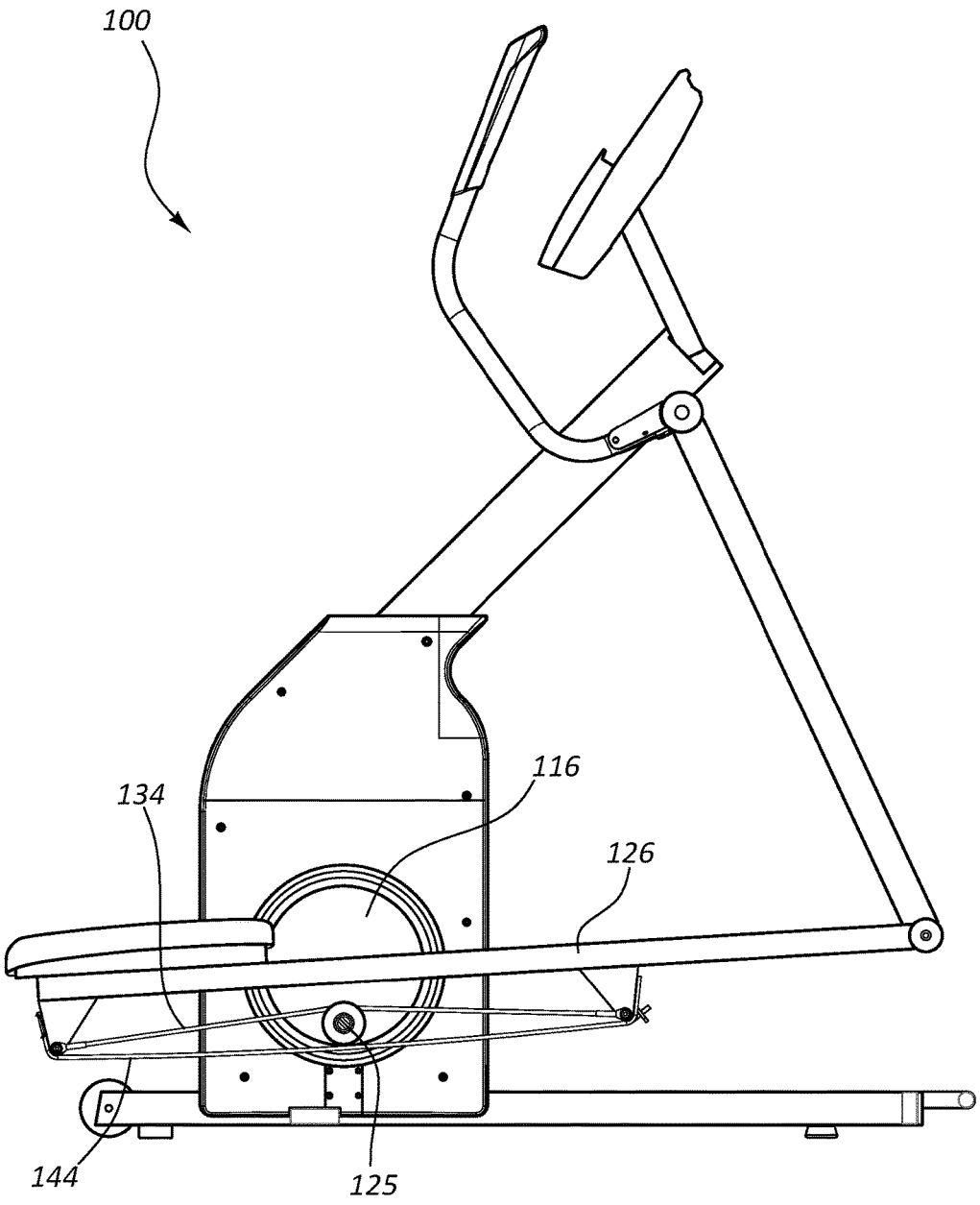
FIG. 3B illustrates a side view of an example of a pedal beam in accordance with the present disclosure.
Figure 3C:
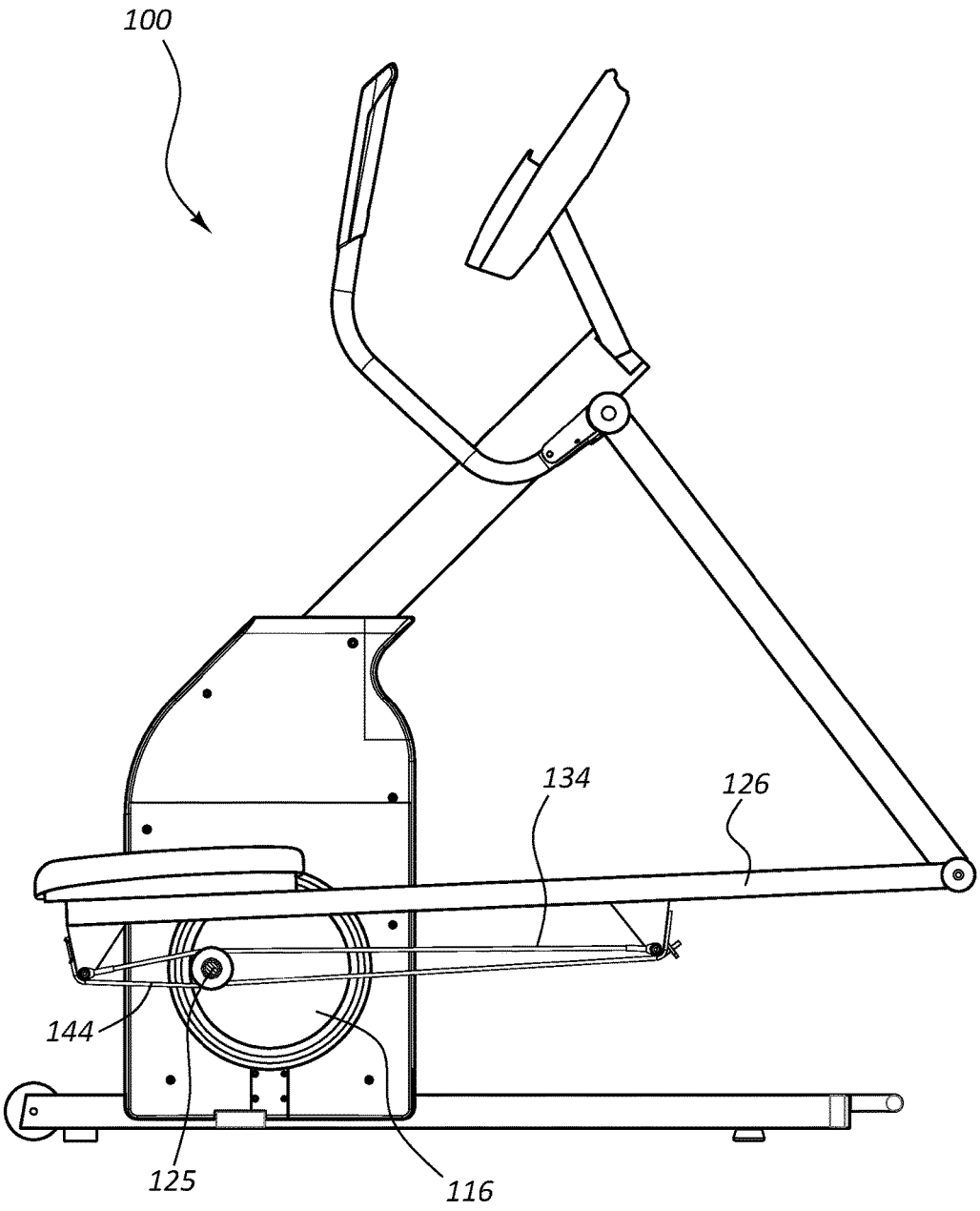
FIG. 3C illustrates a side view of an example of a pedal beam in accordance with the present disclosure.

FIGS. 3A-3C depict the relative movement of the roller 125 and the tensioned elements 134, 144. FIG. 3A depicts the roller 125 approaching a first underside location 136. FIG. 3B depicts the roller moving within a mid-section 300 of the underside 132. FIG. 3C depicts the roller approaching a second underside location 140. One or more of the first and second underside locations 136, 140 may be an end of the pedal beam's underside 126. In other examples, one of more of the underside locations is located along a mid-portion of the underside 132. For example, the first underside location 136 depicted in FIG. 2 is located in a mid-section of the underside 132, while the second underside location 140 is located at an end of the underside. In other examples, both of the first and second underside locations 136, 140 are located in mid-portions of the underside 132. In yet other examples, both of the first and second underside locations 136, 140 are proximate or at the underside ends. In an additional example, the second underside location 140 is located in a mid-portion of the underside 132 while the first underside location is located at or near an underside end.

In some examples, the roller 125 is continuously engaged with the first tensioned element 134 during the performance of an exercise as is depicted across FIGS. 3A-3C. Further, the first tensioned element 134 may be engaged with the roller 125 when the exercise machine 100 is not being used in the performance of an exercise.

The second tensioned element 144 may be continuously engaged with the roller 125 during the performance of an exercise. However, in the illustrated examples, the second tensioned element 144 is intermittently engaged with the roller 125 during a performance of an exercise. In such examples, the second tensioned element 144 may or may not be engaged with the roller 125 when the exercise machine is not being used during the performance of an exercise depending on the location of roller along the underside's length when the exercise machine 100 is at rest. For example, the roller 125 may not be engaged with the second tensioned element 134 within a middle region of the second tensioned element 134.

The first tensioned element 134 may impose a force on the roller 125 in a first direction. When the exercise machine 100 is in an upright position, the direction of the force imposed by the first tensioned element 134 may be a downward direction. In such an example, the roller 125 may impose an upward force on the first tensioned element 134 such that the first tensioned element 134 is urged upward at the point where the roller 125 and the first tensioned element 134 are engaged. In the performance of an exercise, the user may move the pedal beams 126 in a reciprocating motion. As the pedal beams 126 move, the point of contact between the roller 125 and the first tensioned element 134 changes. The roller 125 may move relative to the first tensioned element 134 along the length of the first tensioned element 134. As the roller 125 approaches one of the underside locations of the pedal beam 126, the angle formed between the roller 125 and the first tensioned element 134 changes such that the angle is steeper on the side with the approaching underside location. As a result, the resistance to the roller's movement from the first tensioned element 134 increases.

Additionally, the second tensioned element 144 also engages the roller 125 as the roller 125 approaches the underside locations 136, 140. Consequently, the second tensioned element also imposes a resistance to the movement of the roller 125. The second tensioned element 144 imposes an upward force on the roller 125 in a different direction to the forces imposed on the roller 125 from the first tensioned element. For example, the force imposed by the first tensioned element changes based on the location of the contact point between the first tensioned element 134 and the roller 125. However, as the contact point approaches the underside locations, the first tensioned element imposes a force with a downward component and a lateral component opposite of the direction that the roller 125 is traveling. When the second tensioned element 144 engages the roller 125, the second tensioned element 144 imposes an force with an upward component and a lateral component. Thus, the force from the second tensioned element 144 is different than the forces imposed by the first tensioned element 134. However, collectively, the forces from the first tensioned element 134 and the second tensioned element 144 resist the movement of the roller 125 as the roller 125 approaches the underside locations. In some cases, these combined forces may prevent the roller 125 from reaching the underside locations.

FIGS. 4A-4E depict examples of rollers 125 that may be used with the examples described above. For example, the roller 125 depicted in FIG. 4A includes a first groove 400 and a second groove 402 formed in a rolling surface 404 of the roller 125. Each of the first and second grooves 400, 402 may include a first side wall 406, a second side wall 408, and a groove floor 410. The first and second grooves 400, 402 may be sized to receive the tensioned elements described above. For example, the first tensioned element 134 may engage the roller 125 in a top side 412 of the first groove 400, the second tensioned element 144 may engage the roller 125 in the top side 412 of the second groove 402, the third tensioned element 146 may engage the roller 125 in a bottom side 414 of the first groove 400, and the fourth tensioned element 148 may engage the roller 125 in the bottom side 414 of the second groove 402. In some examples, one or both of the first and second side walls 406, 408 may be lateral load bearing surfaces that are capable of resisting the tensioned element's lateral loads. Such lateral load bearing surfaces may resist the roller 125, and therefore other components of their respective pedal assemblies, from significantly moving in a lateral direction during the performance of an exercise. While the tensioned elements may still allow for some lateral movement, the first and second side walls 406, 408 may restrict the lateral movement of the respective pedal assemblies during the performance of an exercise.

In examples where at least one cable is used as a tensioned element, the cable may have a sufficient diameter to resist lateral loads and may outperform flatter tensioned elements with a small thickness. For example, straps with a relatively thin thickness compared to the width of the strap risk buckling along their width when a side load is imposed when the height of the load bearing surface is approximately the thickness of the side wall. Such buckling compromises the straps' ability to be retained by a lateral load bearing surface as the strap may move over the lateral load bearing surface. However, in examples incorporating a cable as the tensioned element, the diameter of the cable may be sufficient to resist lateral buckling thereby restraining the cable within the groove. In examples where a cable is used and the height of the side wall is about the diameter of the cable, the cable and side wall can resist the lateral loads with much less risk of buckling.

Figure 4A:
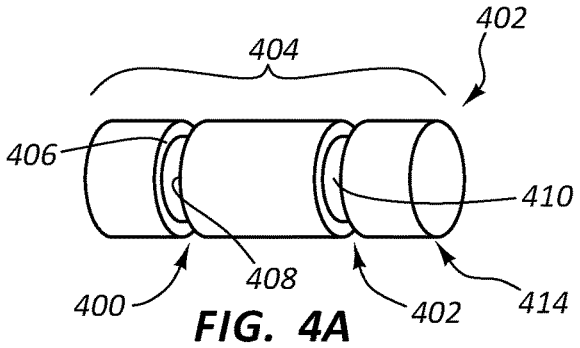
FIG. 4A illustrates an example of a roller in accordance with the present disclosure.
Figure 4B:
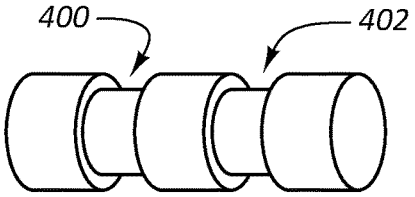
FIG. 4B illustrates an example of a roller in accordance with the present disclosure.

In the example of FIG. 4B, the first and second groove 400, 402 have a greater width that those depicted in FIG. 4A. The larger widths may allow for wider straps to be attached to the underside 132 of the pedal beams 126. In other examples, multiple cables or other types of tensioned elements may be engaged within each of the first and second grooves 400, 402.

In the examples of FIGS. 4A and 4B, the multiple grooves 400, 402 may be within the middle seventy five percent of the rolling surface 404 of the roller 125. Likewise, one or more of the lateral load bearing surfaces may be within the middle seventy five percent. In other examples, the lateral load bearing surfaces may be within a middle sixty five percent of the rolling surface 404, a middle fifty percent of the rolling surface 404, a middle thirty five percent of the rolling surface 404, a middle twenty five percent of the rolling surface 404, a middle ten percent of the rolling surface 404, another middle percentage of the rolling surface 404, or combinations thereof.

Figure 4C:
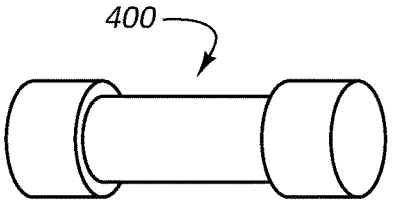
FIG. 4C illustrates an example of a roller in accordance with the present disclosure.

In the example of FIG. 4C, a single wide groove 400 is formed in the rolling surface 404 of the roller 125. In such an example, a strap, multiple cables, or other types of tensioned elements may be used to engage the roller 125 in the groove. In examples where multiple tensioned elements are used within the same groove, the side walls 406, 408 may resist the collective lateral loads of the multiple tensioned elements. For example, a first tensioned element within a single groove may impose a lateral force on a second tensioned element within the same groove. The lateral load from the first tensioned element may cause the second tensioned element to move into the side wall of the groove where the side wall resists the movement of the second tensioned element from moving laterally any more. The result of resisting the second tensioned element from moving any more also resists the first tensioned element's movement. Thus, the lateral load bearing surface of the side walls 406, 408 may resist movement of those tensioned element in which they are not in direct contact.

Figure 4D:
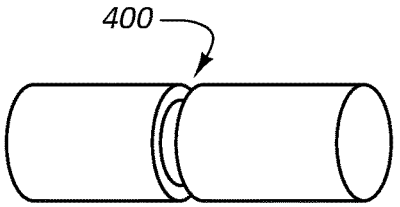
FIG. 4D illustrates an example of a roller in accordance with the present disclosure.

In the example of FIG. 4D, a single narrow 400 groove is formed in the rolling surface 404. In this example, the single groove may accommodate a narrow tensioned element. In some examples, the single tensioned element is a cable. While the examples above depict a single groove that is centered in the rolling surface 404 or multiple grooves that are symmetric in the rolling surface 404, one or more of the groove may be positioned asymmetrically in the rolling surface 404.

Figure 4E:
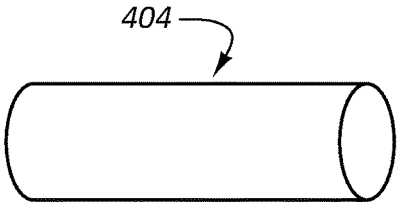
FIG. 4E illustrates an example of a roller in accordance with the present disclosure.

FIG. 4E depicts a rolling surface 404 without any grooves. In such an example, the roller 125 does not prevent the tensioned element from slipping off of the roller 125 other than with the friction between the tensioned element and the rolling surface 404. In some examples, the lateral friction between the tensioned element and the rolling surface 404 is sufficient to prevent the tensioned element from slipping off of the roller 125. In other examples, the rolling surface 404 has a low friction surface.

Figure 5:
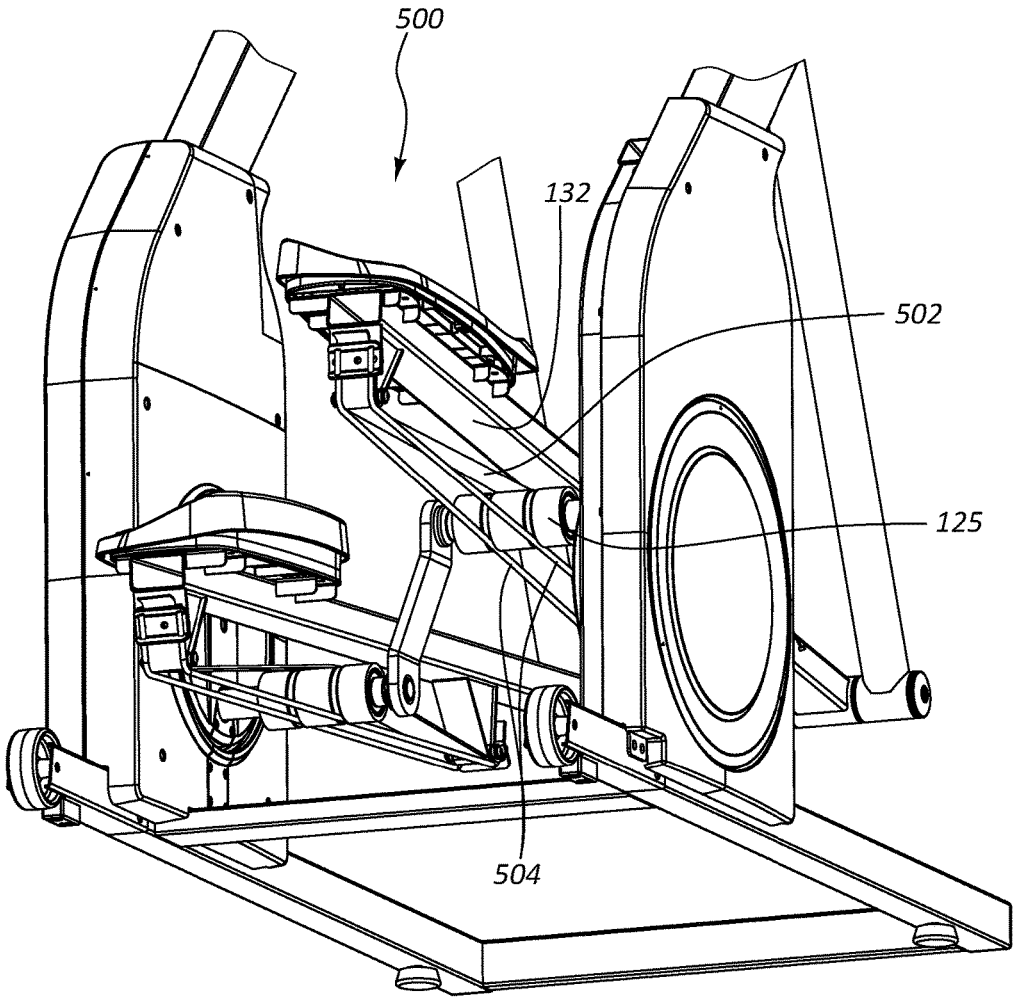
FIG. 5 illustrates an example of a roller in accordance with the present disclosure.

In the example of FIG. 5, the exercise machine 100 includes a pedal assembly 500 with a pedal beam 126 and a roller 125. In this example, the strap tensioned element 502 is a strap that imposes a first force on the roller 125. The strap tensioned element 502 imposes a downward force on the roller 125 when the exercise machine 100 is in an upright position during the performance of an exercise. As the roller 125 approaches the underside locations 136, 140, the angle of the force imposed by the strap tensioned element 502 changes to slow down the roller 125 and, in some cases, resists the roller 125 from reaching the underside locations 136, 140.

FIG. 5 also depicts at least one cable tensioned element 504 spanning a portion of the underside 132. These cable tensioned elements 504 may engage the roller 125 in grooves that incorporate at least one lateral load bearing surface. Thus, one of the tensioned elements may resist lateral movement of the roller 125 while at least one other tensioned element contributes less or not at all to resisting lateral movement of the roller 125. The cable tensioned elements 504 may impose a force on the roller 125 in a different direction than the strap tensioned element 502. For example, the cable tensioned elements 504 may impose a force on the roller 125 that has at least an upward component. In some cases, the cable tensioned elements 504 may not be engaged with the roller 125 during certain portions of the pedal beam's underside 132, such as in the middle of the portion. In other examples, the cable tensioned elements 504 are in continuous contact with the roller 125 throughout the performance of the exercise.

While this example depicts two types of tensioned elements being used in the exercise machine, other types of tensioned elements may be used in combination with each other. In alternative examples, the cable tensioned element 504 may impose a force with a downward component on the roller 125, while in other examples, the strap tensioned element 502 is used to impose a force with an upward component on the roller 125. In yet other examples, the strap and cable elements may be used to direct a force on the roller from the same side of the roller. In further examples, the belt tensioned elements or other types of tensioned elements may be used to direct forces with upward components or downward components on the roller 125.

Figure 6:
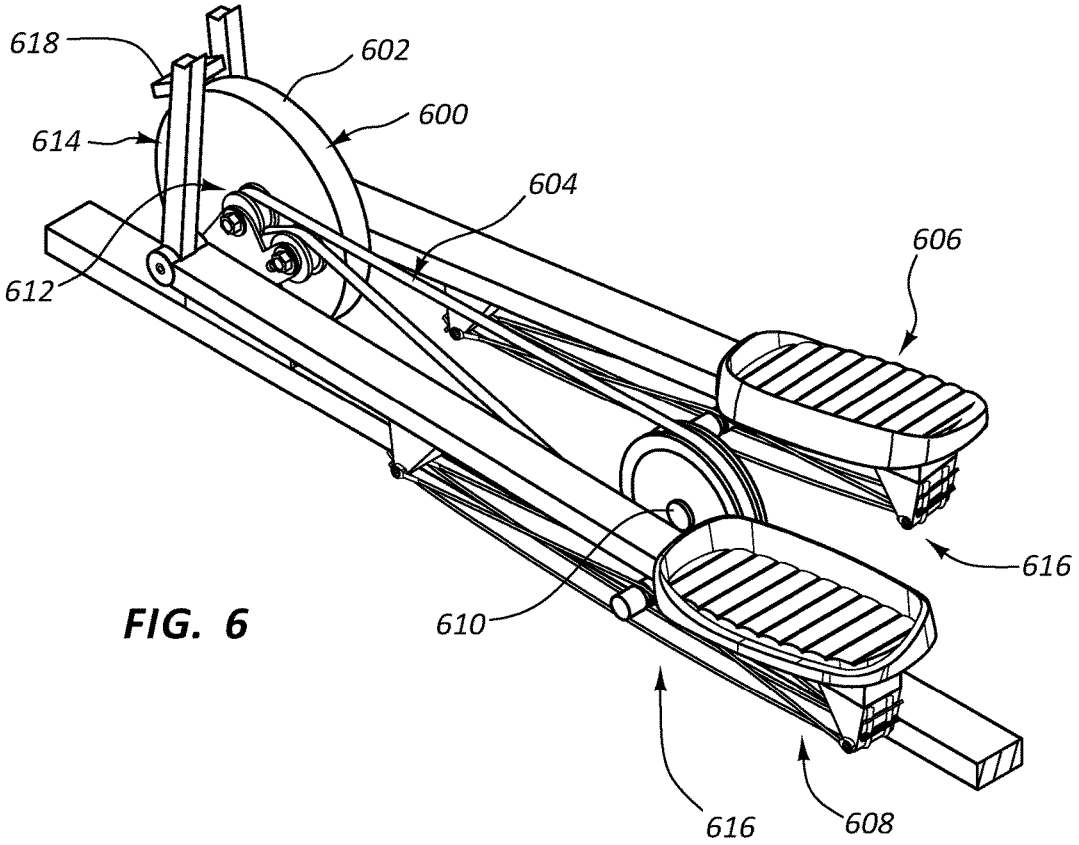
FIG. 6 illustrates an example of an exercise machine in accordance with the present disclosure.
Figure 7:
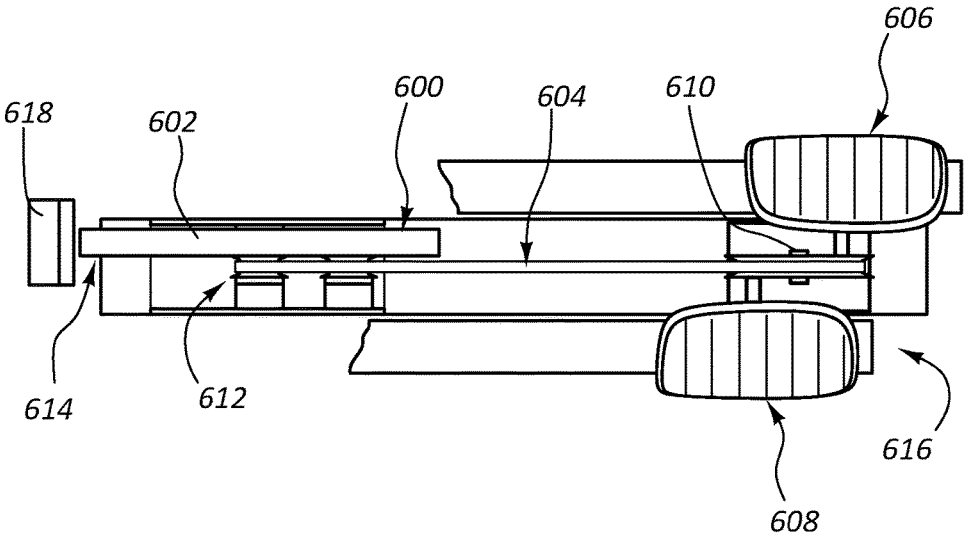
FIG. 7 illustrates a top view of an example of an exercise machine in accordance with the present disclosure.

In the examples of FIGS. 6 and 7, the exercise machine 100 includes a resistance mechanism 600 that includes a flywheel 602 and a transmission 604. At least a portion of the resistance mechanism 600 is positioned between a first pedal assembly 606 and a second pedal assembly 608. In some examples, just a portion of the transmission 604 is positioned between the first and second pedal assemblies 606, 608. While in other examples, the flywheel 602 and the transmission 604 are depicted between the first and second pedal assemblies 606, 608. Further, in an example, the resistance mechanism 600 includes a flywheel 602 that is connected directly to a crank axle 610.

The transmission 604 may include a transmission belt, a transmission chain, another type of transmission linkage, or combinations thereof that connect the flywheel 602 to the crank axle 610. The transmission 604 may connect to a flywheel axle 612, to an outer surface 614 of the flywheel 602, or to another component of a flywheel assembly. Likewise, another end of the transmission 604 may connect directly to the crank axle 610 or to another portion of the crank assembly in communication with the crank axle.

As the user moves the pedal beams 126 of the first and second pedal assemblies 606, 608, the crank assembly 616 causes the crank axle 610 to rotate. The flywheel 602 moves with the rotation of the crank axle 610 through the linkage of the transmission 604.

In some examples, the rotation of the flywheel 602, and therefore the rotation of the crank axle 610 and the first and second pedal assemblies 606, 608 is resisted with a magnetic force. Such a magnetic force may be imposed on the flywheel 602 from a magnetic unit 618 that is adjacent the flywheel 602. The magnetic unit 618 may be movable with respect to the flywheel 602. In such examples, the magnetic resistance on the flywheel 602 may be changed by moving the magnetic unit 618 with respect to the flywheel 602. In other examples, the magnetic force from the magnetic unit can be altered with varying amounts of electrical power. In these examples, the amount of magnetic resistance imposed on the flywheel 602 may be varied by altering the amount of electrical power supplied to the magnetic unit.

Figure 8:
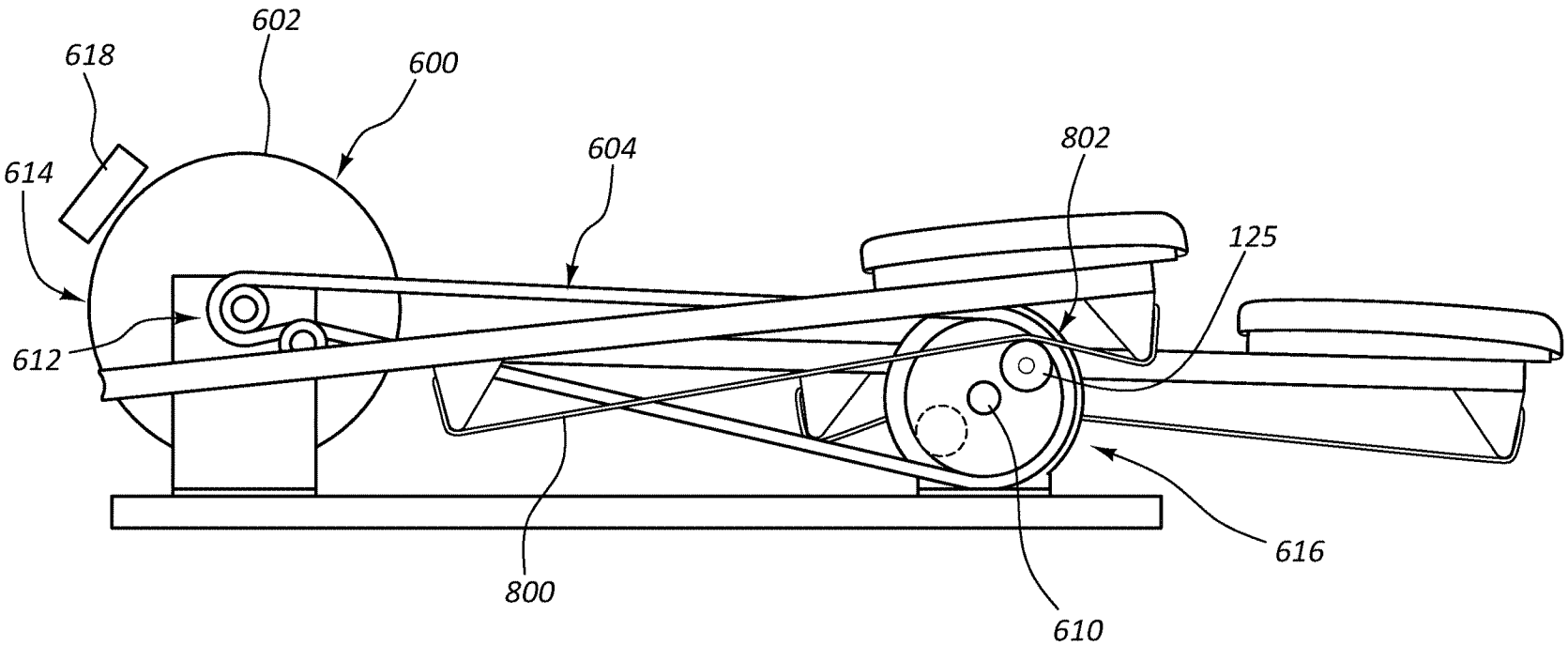
FIG. 8 illustrates an example of an exercise machine in accordance with the present disclosure.

FIG. 8 depicts an example of an exercise machine 100 where the first and second pedal assemblies 606, 608 have tensioned elements 800 positioned to engage the roller 125 from a top side 802. These tensioned elements 800 may impose a force on the roller 125 with at least a downward component during the performance of an exercise. Further, the tensioned elements 800 may include at least one cable that is positioned to engage the roller 125 in a groove 400 formed in the rolling surface 404 of the roller 125. The groove 400 may include at least one groove wall 406 that includes a lateral load bearing surface. Such a groove 400 can reduce the amount of movement that the tensioned element 800 can move laterally.

Figure 9:
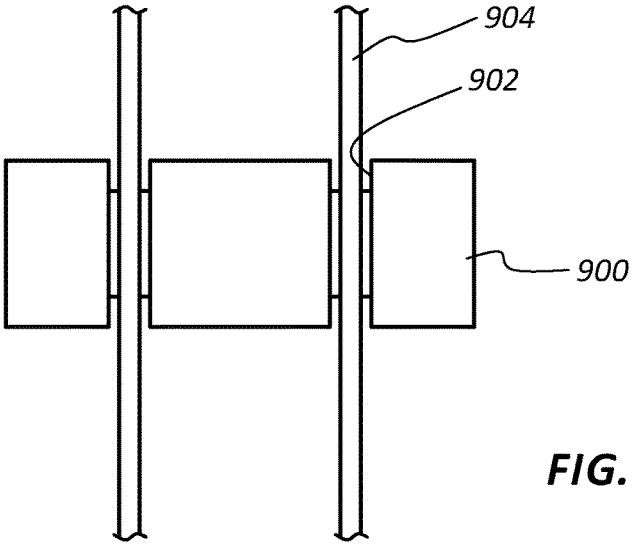
FIG. 9 illustrates an example of a pedal assembly in accordance with the present disclosure.

FIG. 9 includes an example of an exercise machine that includes a frame and a resistance mechanism attached to the frame. In this example, a crank assembly is in mechanical communication with the resistance mechanism. The crank assembly includes a crank arm and a roller 900 connects to the crank arm. At least one internal load bearing surface 902 is integrated into the roller 900. A pedal assembly is movably attached to the crank assembly and is movable in the performance of an exercise. The pedal assembly may include a pedal beam and at least one tensioned element 904 that spans a portion of the underside of the pedal beam. The tensioned element 904 guides the roller 900 with the internal lateral load bearing surface during the performance of the exercise.

Figure 10:
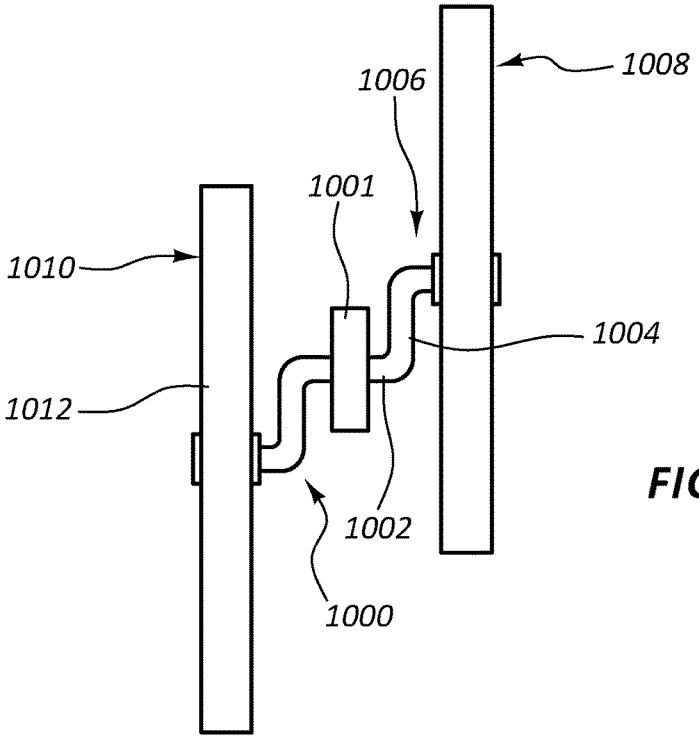
FIG. 10 illustrates an example of a roller in accordance with the present disclosure.

FIG. 10 depicts an example of an exercise machine 100 that includes a frame and a resistance mechanism 1001 attached to the frame. A crank assembly 1000 is in mechanical communication the resistance mechanism 1001, and the crank assembly 1000 includes a crank axle 1002, a crank arm 1004 connected to the crank axle 1002, and roller connected to a distal end 1006 of the crank arm 1004. The exercise machine 100 includes a first pedal assembly 1008 movably attached to the crank assembly 1000 and movable in the performance of an exercise, and a second pedal assembly 1010 movably attached to the crank assembly 1000 and movable in the performance of the exercise.

Each of the first pedal assembly 1008 and the second pedal assembly 1010 includes a pedal beam 1012 and a tensioned element spanning at least a portion of an underside of the pedal beam 1012. At least a portion of the resistance mechanism is disposed between the first pedal assembly and the second pedal assembly.

Figure 11:
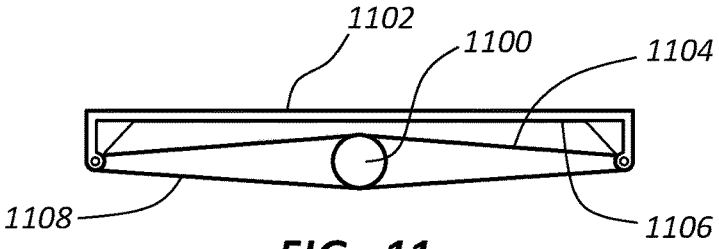
FIG. 11 illustrates an example of an exercise machine in accordance with the present disclosure.

FIG. 11 depicts an example of an exercise machine that includes a frame and a resistance mechanism attached to the frame. A crank assembly is in mechanical communication with the resistance mechanism. The crank assembly includes a crank arm and a roller 1100 connected to the crank arm. The exercise machine also includes a pedal assembly movably attached to the crank assembly and movable in the performance of an exercise. The pedal assembly includes a pedal beam 1102, a first tensioned element 1104 that spans at a first portion of the underside 1106, and a second tensioned element 1108 that spans a second portion of the underside 1106 of the pedal beam 1102. The roller 1100 is disposed between the first tensioned element 1104 and the second tensioned element 1108.

INDUSTRIAL APPLICABILITY

In general, the systems and methods disclosed herein may provide the user with an exercise machine that includes a frame and a resistance mechanism attached to the frame. A crank assembly is in mechanical communication with the resistance mechanism. The crank assembly includes a crank arm and a roller connected to the crank arm. The exercise machine also includes a pedal assembly movably attached to the crank assembly and movable in the performance of an exercise. The pedal assembly may include a pedal beam, a first tensioned element that spans at a first portion of the underside, and a second tensioned element that spans a second portion of the underside of the pedal beam. In such cases, the roller may be disposed between the first tensioned element and the second tensioned element.

The pedal beam includes an underside with a first tensioned element that spans at least a portion of the length of the underside. The tensioned element may be attached to a first underside location at a first tensioned element end and attached to a second underside location at a second tensioned element end. In some examples, the tensioned element spans the entire length of the underside. Further, a second tensioned element may also span at least a portion of the underside. In the illustrated example, the second tensioned element may span the entire length of the underside. In some examples, the first tensioned element may span a different portion of the underside than the second tensioned element, but such different portions may have regions the overlap where the roller can operate. Further, in other examples, the first tensioned element and the second tensioned element span the same portion of the underside.

Connecting the crank assembly to the pedal assemblies by engaging the rollers with the tensioned elements allows the user to move the pedal assemblies with more degrees of freedom than possible with conventional elliptical exercise machines. For example, a conventional elliptical exercise machine connects the various components of the crank assembly to the pedal and arm assemblies with rigid or sliding connections that require the foot support of the conventional elliptical exercise machine to travel along a fixed pathway. In such conventional elliptical exercise machines, the path of reciprocating travel involves the foot support traveling at the same angular distance along an entire revolution of the pedal. However, with an exercise machine as described above, the user has additional degrees of freedom. For example, the user may slide the pedal with respect to the pedal beam. Thus, the angular distance for each revolution can change based on how the user chooses to move his or her feet. To change such an angular distance, the user does not have to get off of the exercise machine and make a mechanical adjustment to the pedal. Instead, the user can merely move his or her feet as desired during the performance of the exercise to make the desired changes. Further, the exercise machine described above allows the user to exercise without having to make revolutions with the pedals at all. For example, the user may use the exercise machine described above as a stepper machine. As mentioned above, the user does not have to make a mechanical adjustment to the components of the exercise machine to change the travel path from a stepping path to a revolution path. The user may merely move his or her feet in the desired direction and the pedals will follow. Thus, the roller and tensioned element arrangement as described above offer degrees of freedom not realized by conventional elliptical exercise machines.

Further, the elasticity of the tensioned elements impose a lower amount of stress on the user's joints during the performance of the exercise. In conventional elliptical exercise machines, the crank and pedal assemblies often include just rigid elements that impose some strain on a user as the user moves the pedals. However, the connection with the tensioned elements to the crank assembly further reduces the strain on the user's joints.

By trapping the roller between the first and second tensioned elements, the roller is prevented from becoming dislodged from the pedal beam during the performance of the exercise. Further, the first tensioned element and the second tensioned element can impose forces on the roller that prevent the roller from actually reaching the end of the pedal beam's underside as the roller moves along the length of the underside. In some cases, where an upward force is imposed on the pedal beams such that the roller disengages from the first tensioned element, the second tensioned element may engage the roller, thereby preventing the pedal beam from becoming separated from the pedal assembly.

In some examples, the roller is continuously engaged with the first tensioned element during the performance of an exercise. Further, the first tensioned element may be engaged with the roller when the exercise machine is not being used in the performance of an exercise. In some cases, the second tensioned element is continuously engaged with the roller during the performance of an exercise. However, in some examples, the second tensioned element is intermittently engaged with the roller during a performance of an exercise. In such examples, the second tensioned element may or may not be engaged with the roller when the exercise machine is not being used during the performance of an exercise. For example, the second tensioned element may engage the roller just as the roller approaches the ends of the pedal beam's underside. Thus, while the roller is moving along a mid-portion of the underside, the roller may be engaged with just the first tensioned element. However, as the roller approaches the ends of the tensioned elements, the second tensioned element may engage the roller resulting in both the first and the second tensioned elements being engaged with the roller at the same time.

The first and the second tensioned elements may contribute to providing forces that at least affect the movement of the roller. The combined forces from the tensioned elements may cause a significant increase in resistance to the rollers' forward or backward movement.

In the illustrated example, the first tensioned element and the second tensioned element are cables. However, any appropriate type of tensioned element may be used in accordance with the principles described in the present disclosure. For example, the tensioned elements may be straps, bands, belts, members made of an elastic material, other types of tensioned elements, or combinations thereof. A non-exhaustive list of materials that may be used in the tensioned element includes leather, fabric, rubber, polymers, synthetic materials, elastic materials, rope, woven materials, plastic, other materials, or combinations thereof.

Further, a third tensioned element and a fourth tensioned element may also be attached to the underside of the pedal beam. The third tensioned element may apply a force in the same, or at least a similar direction, as the first tensioned element. The fourth tensioned element may apply a force in the same, or at least a similar direction, as the second tensioned element. For example, the first and third tensioned elements may contact a top portion of the roller, and the second and fourth tensioned elements may contact a bottom portion of the roller. Any appropriate number of tensioned elements may be used in accordance with the principles described herein. In some cases, an uneven amount of tensioned elements are used for different sides of the roller. For example, more tensioned elements may engage the roller at a top side than the bottom side or vice versa.

In some examples, an exercise machine includes at least one internal load bearing surface that is integrated into the roller, and the tensioned element guides the roller with the internal lateral load bearing surface during the performance of the exercise.

The internal load bearing surface may be incorporated into a first groove and a second groove formed in a rolling surface of the roller. Each of the first and second grooves may include a first side wall, a second side wall, and a groove floor. The first and second grooves may be sized to receive the tensioned elements described above. For example, the first tensioned element may engage the roller in a top side of the first groove, the second tensioned element may engage the roller in the top side of the second groove, the third tensioned element may engage the roller in a bottom side of the first groove, and the fourth tensioned element may engage the roller in the bottom side of the second groove. The lateral load bearing surfaces may be capable of resisting the tensioned element's lateral loads. Such lateral load bearing surfaces may resist the roller, and therefore other components of the roller's respective pedal assemblies, from significantly moving in a lateral direction during the performance of an exercise. While the tensioned elements may still allow for some lateral movement, the first and second side walls may restrict the lateral movement of the respective pedal assemblies during the performance of an exercise.

In examples where at least one cable is used as a tensioned element, the cable may have a diameter large enough to resist lateral loads which may outperform flatter tensioned elements with a small thickness. For example, straps with a relatively thin thickness compared to the width of the strap risk buckling along their width when a side load is imposed when the height of the load bearing surface is approximately the thickness of the side wall. Such buckling compromises the straps' ability to be retained by a lateral load bearing surface as the strap may move over the lateral load bearing surface. However, in examples incorporating a cable as the tensioned element, the diameter of the cable may be sufficient to resist lateral buckling thereby restraining the cable within the groove. In examples where a cable is used and the height of the side wall is about the diameter of the cable, the cable and side wall can resist the lateral loads with much less risk of buckling.

The grooves in the rolling surface may include any appropriate dimension. For example, the width of the groove may span majority of the rolling surface. In other instances, the width of the groove may span less than five percent of the rolling surface. The larger widths may allow straps to be engaged with the rollers within the grooves. The bottom floor of the grooves may include a flat profile, a curved profile, a symmetric profile, an asymmetric profile, another type of profile, or combinations thereof. Further, the depth of the groove may be greater than the thickness of the tensioned element, greater than the diameter of the tensioned element, about the height of the tensioned element, smaller than the height of the tensioned element, or combinations thereof.

In another embodiment, the crank assembly is in mechanical communication with the resistance mechanism, and the crank assembly includes a crank axle, a crank arm connected to the crank axle, and a roller connected to a distal end of the crank arm. The exercise machine includes a first pedal assembly movably attached to the crank assembly and movable in the performance of an exercise, and a second pedal assembly movably attached to the crank assembly and movable in the performance of the exercise.

Each of the first pedal assembly and the second pedal assembly include a pedal beam and a tensioned element spanning at least a portion of an underside of the pedal beam. At least a portion of the resistance mechanism is disposed between the first pedal assembly and the second pedal assembly.

The transmission may include a transmission belt, a transmission chain, another type of transmission linkage, or combinations thereof that connects the flywheel to the crank axle. The transmission may connect to a flywheel axle or to an outer surface of the flywheel. Likewise, another end of the transmission may connect directly to the crank axle or to another portion of the crank assembly in communication with the crank axle.

As the user moves the pedal beams of the first and second pedal assemblies, the crank assembly causes the crank axle to rotate. The flywheel moves with the rotation of the pedal axle through the linkage of the transmission. Thus, as the resistance is increased to rotate the flywheel, the resistance is transmitted to the movement of the crank assembly through the crank axle.

In some examples, the rotation of the flywheel, and therefore the rotation of the pedal axle and the first and second pedal assemblies is resisted through with a magnetic force. Such a magnetic force may be imposed on the flywheel from a magnetic unit that is adjacent the flywheel. The magnetic unit may be movable with respect to the flywheel. In such examples, the magnetic resistance on the flywheel may be changed by moving the magnetic unit with respect to the flywheel. In other examples, the magnetic force from the magnetic unit can be altered with varying amounts of electrical power. In these examples, the amount of magnetic resistance imposed on the flywheel may be varied by altering the amount of electrical power supplied to the magnetic unit.

While the examples above have been described with multiple tensioned elements in a pedal assembly, just a single tensioned element may be used to engage the roller. Further, any appropriate number of tensioned elements may be used in the pedal assemblies. For example, the pedal assemblies may use a single tensioned element, two tensioned elements, three tensioned elements, four tensioned elements, more than four tensioned elements, an even number of tensioned elements, an odd number of tensioned elements, or combinations thereof.

Additionally, while the examples above have been described with a specific number of flywheels, any appropriate number of flywheels may be used in accordance to the disclosure. For example, the exercise machine may incorporate a single flywheel, two flywheels, more than two flywheels, an even number of flywheels, an odd number of flywheels, or combinations thereof.

What is claimed is:

1. An exercise machine, comprising:

a frame;

a resistance mechanism attached to the frame;

a crank assembly in mechanical communication with the resistance mechanism, the crank assembly including a crank arm, a roller connected to the crank arm, and at least one load bearing surface integrated into the roller; and a pedal assembly movably attached to the crank assembly, the pedal assembly including a first pedal beam, and a first tensioned element connected to the first pedal beam that spans a first portion of an underside of the first pedal beam and a second tensioned element connected to the first pedal beam that spans a second portion of the underside of the first pedal beam;

wherein the first tensioned element engages the at least one load bearing surface and guides the roller during operation; and the second tensioned element engages and guides the roller during operation.

2. The exercise machine of claim 1, wherein the first tensioned element is a cable.

3. The exercise machine of claim 2, wherein the cable is sized to fit within a groove formed in a surface of the roller, wherein the at least one load bearing surface is a side wall of the groove.

4. The exercise machine of claim 3, wherein the groove is formed within a middle seventy five percent of a rolling surface of the roller.

5. The exercise machine of claim 1, wherein the first tensioned element and the second tensioned element are positioned to contact a first load bearing surface formed in a first groove of a rolling surface of the roller, and a third tensioned element and a fourth tensioned element are positioned to contact a second load bearing surface formed in a second groove of the rolling surface of the roller.

6. The exercise machine of claim 5, wherein the first tensioned element and the third tensioned element impose a first force on the roller in a first direction as the roller moves during operation.

7. The exercise machine of claim 6, wherein the first tensioned element and the third tensioned element impose a second force on the roller in a second direction different than the first direction as the roller moves during operation.

8. The exercise machine of claim 1, wherein the roller is disposed between the first tensioned element and the second tensioned element.

9. The exercise machine of claim 1, further comprising:

a third tensioned element that spans the first portion of the underside of the first pedal beam; and a fourth tensioned element that spans the second portion of the underside of the first pedal beam.

10. The exercise machine of claim 1, wherein the first tensioned element and the second tensioned element each impose an increasing amount of resistance to movement of the roller as the roller approaches an end location of the underside during operation.

11. The exercise machine of claim 1, wherein the first tensioned element and the second tensioned element collectively prevent the roller from reaching an end location of the underside in the performance of the exercise.

12. The exercise machine of claim 1, wherein the at least one load bearing surface is a side wall of a groove formed in a rolling surface of the roller.

13. An exercise machine, comprising:

a frame;

a resistance mechanism attached to the frame;

a crank assembly in mechanical communication with the resistance mechanism;

the crank assembly comprising;

a crank arm;

a roller connected to the crank arm; and a first groove with at least one load bearing surface in a first side wall formed in a rolling surface of the roller;

the first groove is formed within a middle seventy five percent of the rolling surface;

a pedal assembly movably attached to the crank assembly and movable in a performance of an exercise;

the pedal assembly, comprising:

a pedal beam;

a first cable that spans a first portion of an underside of the pedal beam;

a second cable that spans a second portion of the underside of the pedal beam;

a third cable that spans the first portion of the underside of the pedal beam;

a fourth cable that spans the second portion of the underside of the pedal beam;

the first cable is sized to fit within the first groove of the roller;

wherein the first cable guides the roller with at least one internal load bearing surface during the performance of the exercise.

14. The exercise machine of claim 13, wherein the first cable and the second cable are positioned to contact the first side wall formed in the first groove, and the third cable and the fourth cable are positioned to contact a second side wall formed in a second groove of the rolling surface of the roller.

15. The exercise machine of claim 14, wherein the first cable and the third cable impose a first force on the roller in a first direction as the roller moves with the performance of the exercise, and the first cable and the third cable impose a second force on the roller in a second direction different than the first direction as the roller moves with the performance of the exercise.

16. The exercise machine of claim 13, wherein the roller is disposed between the first cable and the second cable.

17. An exercise machine, comprising:

a frame;

a resistance mechanism attached to the frame;

a crank assembly in mechanical communication with the resistance mechanism;

the crank assembly, comprising:

a crank arm; and a roller connected to the crank arm; and a first groove with at least one load bearing surface in a first side wall formed in a rolling surface of the roller;

the first groove is formed within a middle seventy five percent of the rolling surface;

a pedal assembly movably attached to the crank assembly and movable in a performance of an exercise;

the pedal assembly, comprising:

a pedal beam;

a first cable that spans a first portion of an underside of the pedal beam;

a second cable that spans a second portion of the underside of the pedal beam;

a third cable that spans the first portion of the underside of the pedal beam; and a fourth cable that spans the second portion of the underside of the pedal beam;

the roller is disposed between the first cable and the second cable;

the first cable and the second cable are positioned to contact the first side wall formed in the first groove, and the third cable and the fourth cable are positioned to contact a second side wall formed in a second groove of the rolling surface of the roller; and wherein the first cable and the third cable impose a first force on the roller in a first direction as the roller moves with the performance of the exercise, and the first cable and the third cable impose a second force on the roller in a second direction different than the first direction as the roller moves with the performance of the exercise.

* * * * *